United States Patent [19]

Salto

[11] 4,083,444

[45] Apr. 11, 1978

[54] REMOVABLE CARTRIDGE FOR AN INKED RIBBON AND RIBBON FEED MECHANISM FOR PRINTING MACHINES

[75] Inventor: Rinaldo Salto, Ivrea (Turin), Italy

[73] Assignee: Ing. C. Olivetti & C., S.p.A., Ivrea (Turin), Italy

[21] Appl. No.: 702,303

[22] Filed: Jul. 2, 1976

[30] Foreign Application Priority Data

Jul. 10, 1975 Italy ..... 68790/75

[51] Int. Cl.[2] ..... B41J 33/50; B41J 33/512

[52] U.S. Cl. ..... 197/151; 197/154; 197/161

[58] Field of Search ..... 101/336; 197/151, 154, 197/157, 160, 161

[56] References Cited

U.S. PATENT DOCUMENTS

| | | | |
|---|---|---|---|
| 2,919,002 | 12/1959 | Palmer | 197/16 |
| 3,513,957 | 5/1970 | Ricciardi et al. | 197/151 |
| 3,731,781 | 5/1973 | Caudill et al. | 197/151 |
| 3,786,906 | 1/1974 | Okabe | 197/161 |
| 3,863,749 | 2/1975 | Perry et al. | 197/151 |
| 3,882,989 | 5/1975 | Morelli | 197/151 |
| 3,887,056 | 6/1975 | Lehman | 197/151 X |
| 3,889,795 | 6/1975 | Garberi et al. | 197/151 |
| 3,899,065 | 8/1975 | Brignole | 197/151 |
| 3,976,184 | 8/1976 | Cappotto | 197/151 |

FOREIGN PATENT DOCUMENTS

| | | | |
|---|---|---|---|
| 2,350,250 | 4/1975 | Germany | 197/161 |

*Primary Examiner*—Paul T. Sewell

*Attorney, Agent, or Firm*—Schuyler, Birch, Swindler, McKie & Beckett

[57] ABSTRACT

An inked ribbon cartridge is removably mountable in a printing machine of the type comprising a support for the cartridge, two transport elements engageable with two spools, respectively, of the cartridge around which the ribbon is wound, two sensing elements for sensing the amount of the ribbon wound on the two spools, respectively, of the cartridge, a ribbon movement reversing mechanism controlled by the sensing elements for determining the direction of the rotation of the two shafts, and a control element for shifting the sensing elements from an operative position in which they sense the ribbon to an inoperative position in which they are disengaged from the spools. The cartridge comprises on a bottom part thereof at least one aperture for access of the sensing elements to the two spools and an opposing part arranged so to co-operate with the control element for the sensing elements as to cause them to shift from the inoperative position to the operative position when the cartridge is mounted on the support of the machine and from the operative position to the inoperative position when the cartridge is removed from said support.

18 Claims, 4 Drawing Figures

REMOVABLE CARTRIDGE FOR AN INKED RIBBON AND RIBBON FEED MECHANISM FOR PRINTING MACHINES

BACKGROUND OF THE INVENTION

The present invention relates to a cartridge for an inked ribbon for printing machine of the type having a support for the cartridge, two transport elements engageable with two spools, respectively, of the cartridge and which can turn in both directions of rotation, two sensing elements for sensing the amount of ribbon wound on the two spools, respectively, of the cartridge, a ribbon movement reversing mechanism controlled by the sensing elements for determining the direction of rotation of the two transport elements, and a control element adapted to act on the sensing elements to shift them from an operative position in which they sense the ribbon to an inoperative position in which they are disengaged from the spools.

An office printing calculator is known in which there is used an inked-ribbon cartridge which is fixed removably to the machine by means of a locking plate pivoted on the support and which latches down over the cartridge to hold it in place.

The mechanism for reversing the movement of the ribbon is provided with a pair of levers (sensing elements) which sense the amount of ribbon wound on the respective spools through an aperture in the cartridge to command the reversal of the movement when the turns of ribbon wound on the feed spool are fewer than a predetermined minimum number. Moreover, the sensing levers are coupled to the locking plate through a cam and lever system for withdrawing the levers from the aperture in the cartridge when the plate is released and rotated for releasing the cartridge from the machine. This locking system is quite simple and enables a simple and reliable mechanism for reversing the movement of the ribbon to be employed on the machine. However, the system requires two different operations, one for mounting the cartridge on the machine and another for locking it in place by means of the plate.

SUMMARY OF THE INVENTION

The object of the present invention is to provide a cartridge for a printing machine and which are simple and inexpensive and which, while allowing a simple and reliable ribbon reversing mechanism to be used in the machine, uses parts of the cartridge for activating the sensing elements of the reversing mechanism.

According to the present invention, there is provided an inked ribbon cartridge for a printing machine of the type which comprises at least one aperture for access of the sensing elements to the two spools and an opposing part arranged so to co-operate with the control element for the sensing elements as to cause them to shift from the inoperative position to the operative position when the cartridge is mounted on the machine and from the operative position to the inoperative position when the cartridge is removed from the machine.

There is further provided such a machine comprising resilient means urging the sensing elements towards the axes of the two transport elements, and wherein the control element maintains the sensing elements in the inoperative position in opposition to the action of the said resilient means when the cartridge is removed from the machine, the machine further comprising hook means arranged to arrest the sensing elements in the proximity of the inoperative position in opposition to the action of the resilient means, and the cartridge having another opposing part arranged to act on the hook means to allow the resilient means to urge the sensing elements towards the axes of the transport elements only when the cartridge is correctly mounted on the support.

BRIEF DESCRIPTION OF THE DRAWING

The invention will be described in more detail, by way of example, with reference to the accompanying drawings, in which:

Referring to FIG. 1, the cartridge 11 for the inked ribbon comprises a container 12 of plastics material which is of substantially parallelepipedal form and provided on its rear side with two arms 13 which embrace a printing or typing head 14 of the machine. The head 14 is movable parallel to the arms 13 towards a paper-bearing platen 16 through the medium of supports 17. The head 14 and the supports 17 are substantially similar to those described in the U.S. Pat. No. 3,957,149 which is incorporated herein as reference.

Figure 1:
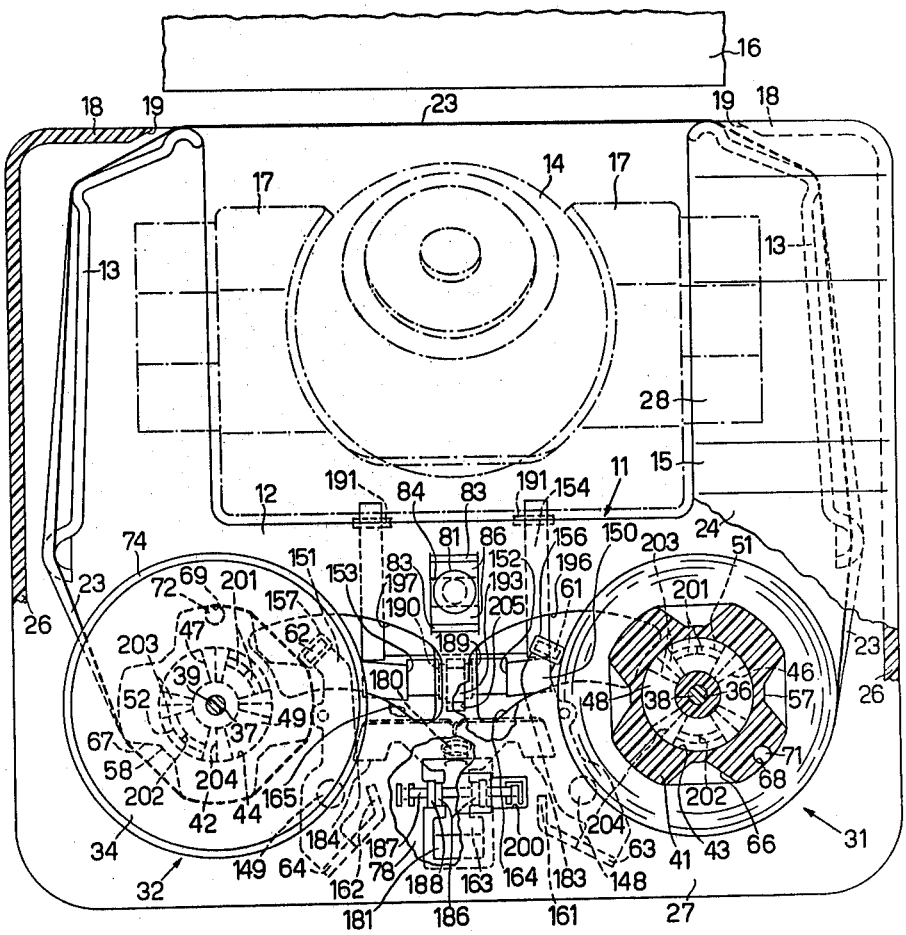
FIG. 1 is a partial plan view of a printing machine on which is mounted a cartridge for the inked ribbon and a corresponding reversing mechanism.

The arms 13 have at their ends 18 two slots or openings 19 which guide an inked ribbon 23 outside the container 12. The arms 13 converge towards the striking zone of the head in such manner as to limit the unguided portion of ribbon 23 extending between the ends 18 of the said arm 13, so as to render the use of a ribbon-raising fork superfluous. In a typical use, the cartridge 11 is mounted on the machine on the outside.

The container 12 is closed at the top by a cover 24 from which there depend side walls 26 substantially perpendicular to the cover 24 and to a base 27 of the container 12. Parts or portions 28 of the cover 24 lying inside the arms 13 are stepped upwardly at 15 (FIG. 2) to form shrouds over the selection mechanisms of the head 14 (which are not shown in the drawings) from possible small objects. The supports 17 of the said head 14 are close to the inner edges of the portions 28 so that larger objects cannot get entangled with the selection mechanisms of the head. This function of the cartridge avoids the need for further protection by the body of the machine. The shrouds slope down towards the platen to allow the line being printed to be seen.

The ribbon 23 is wound on a pair of spools 31 and 32 rotatable in the container 12 so as to transport the ribbon 23 from one spool to the other by way of the arms 13 and through the openings 19. Each of the spools 31 and 32 comprises at the top a flange 33 (FIG. 2), 34 (FIG. 1), having central holes 36 and 37 which receive guide pins 38 and 39 of the cover 24, around which the spools 31 and 32 can rotate. Each of the spools 31 and 32 has a sleeve 41, 42 forming a hub integral with the respective flange 33 (FIG. 2), 34 (FIG. 1) and having an annular hollow space 43, 44 coaxial with the hole 36, 37. In each of the hollow spaces 43, 44 there is housed a ring gear 46, 47 constituted by four teeth and a bearing flange 48, 49, adapted to co-operate with teeth 51 and 52 of transport elements 53 and 54 (FIG. 3) of a reversing mechanism 56.

Figure 3:
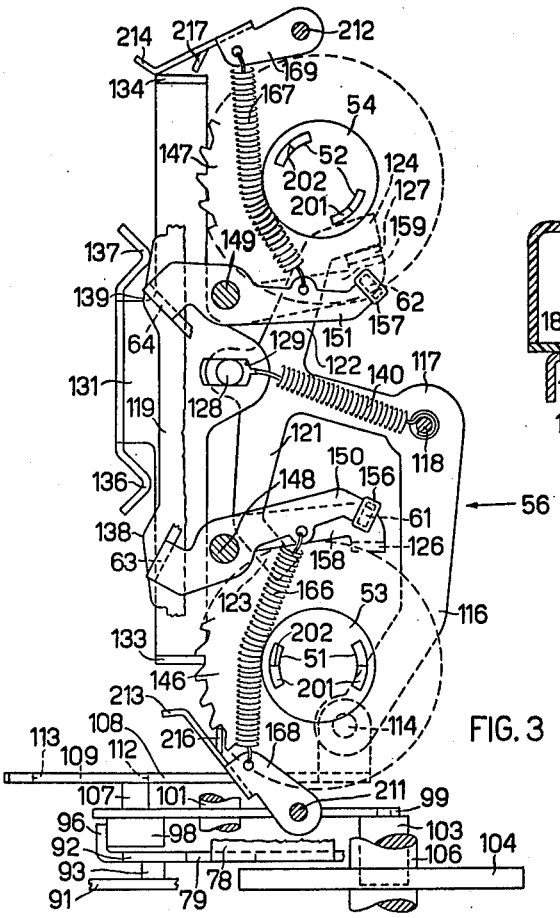
FIG. 3 is a partial plan view of a number of details of FIG. 1.

Each sleeve 41, 42 (FIG. 1) has four circumferentially spaced external recesses 57, 58 adapted to accommodate a lug 61, 62 of a sensing element 63, 64 of the reversing mechanism 56 (FIG. 3). The recesses 57, 58 (FIG. 1) are disposed at 90° from each other and have inclined walls 66 and 67, adapted to co-operate, in an operative stage, with the respective lugs 61, 62 of the sensing elements 63, 64. Each sleeve 41, 42 moreover comprises a hole 68, 69, each of which holes fixes one end of the inked ribbon 23 to the spools 31 and 32 by means of a pin 71, 72.

When the cartridge 11 is removed from the machine, each of the spools 31 and 32 normally bears at the bottom of the sleeves 41 and 42 against the base 27 of the container 12. On the other hand, when the cartridge 11 is mounted on the machine, each of the spools 31 and 32 is kept bearing against the lower face of the cover 24 by means of rims 73 (FIG. 2) and 74 (FIG. 1), under the action of springs 76 (FIG. 2) of the respective transport elements 53 and 54 (FIG. 3), as described hereinafter.

The cartridge 11 (FIG. 1) is mounted on the machine so that it rests on an upper plate 78 of a support 79 (FIG. 3) in which the reversing mechanism 56 is housed. The cartridge 11 (FIG. 4) is normally kept fixed removably to the plate 78 by means of a snap locking device which comprises a headed stud or catch element 81 fixed to the plate and adapted to fit through a hole 82 in the base 27 of the container 12, and engage between two resilient tongues 83 having wedge-shaped projections 84 adapted to co-operate, at their upper edges 86, with a circular shoulder 87 of the stud 81 to keep the cartridge 11 fixed to the plate 78. The stud 81 has its head 88 in the form of a truncated cone adapted to co-operate with a lower edge 89 of each projection 84 in such manner as to assist the passage of the head 88 between the projections 84 for the subsequent snap locking of the cartridge 11 on the machine.

As regards the mechanism for raising the ribbon 23, the support 79 (FIG. 3) is pivoted to a fixed frame 91 of the machine on two lugs 92 and two pins 23, a single pair of which is shown in the drawings. Moreover, an arm 97 integral with the support 79 (FIG. 2) is urged by a spring 94 to press a lug 96 against a pin 98 of a driving member 99. The driving member 99 comprises a lever which can turn on spindle 101 and, under the action of a spring 102, is normally caused to bear by means of a roller 103 against a cam 104 controlling the raising of the cartridge and the ribbon reversing mechanism and which is fixed on a driving shaft 106.

As regards the reversing mechanism 56, the lever 99 carries a second pin 107, coaxial with the pin 98, which co-operates with a cam element 108 constituted by a connecting rod having at one end a slot 109 in the form of a wide 'V' in which the pin 107 is accommodated. A spring 111 fitted between the end of the connecting rod 108 and the lever 109 normally holds the pin 107 bearing against one of the two ends 112 and 113 of the slot 109, as described hereinafter. The connecting rod 108 is connected at the other end by means of a pin 114 to an arm 116 (FIG. 3) of a rocking lever 117 pivoted on a pin 118 fixed to a lower plate 119 (FIG. 2) of the support 79. The rocking lever 117 has two arms 121 and 122 adapted to co-operate by means of their ends 123 and 124 with two lugs 126 and 127 of the sensing elements 63 and 64.

The rocking lever 117 is connected by means of a pin 128 seated in a slot 129 to a ratchet device 131. This ratchet device 131 is constituted by a slider slidable parallel to the transport elements 53 and 54 and guided between the lower face of the plate 119 (FIG. 2) and a pair of lugs 132 of the said plate 119, only one of which is shown in the drawings. The slider 131 (FIG. 3) has at its ends two feed elements or lugs 133 and 134 adapted to co-operate selectively with the transport elements 53 and 54. The slider 131 moreover comprises two projections 136 and 137 adapted to co-operate selectively with two cam surfaces 138 and 139 of the plate 119. A spring 140 fitted between the slot 129 and the pin 118 normally keeps the slider 131 bearing by means of one of the two projections 136, 137 against the respective cam surface 138 or 139.

Each of the transport elements 53 and 54 is constituted by a sleeve from which project the teeth 51 and 52, respectively, which extend through a hole 141 (FIG. 2) in the support 79 and a hole 143 in the base 27 of the cartridge 11 to co-operate with the respective flanges 48 and 49 (FIG. 1). Moreover, each of the elements 53 and 54 (FIG. 3) comprises a gear wheel 146, 147, respectively, adapted to co-operate with the corresponding lug 133, 134.

Each sensing element 63, 64 is constituted by a bail which can turn on a pin 148, 149 of the support 79 and having an upper arm 150, 151 adapted to co-operate with a tooth 152, 153 (FIG. 1) of a hook element 154. From the ends of the arms 150, 151 there are formed the lugs 61 and 62, respectively, over which there are fitted caps 156 and 157 of plastics material which are adapted in turn to bear against the turns of inked ribbon 23 which are wound on the spools 31, 32 through apertures or slots 164, 165 in the plate 78. Each of the bails 63, 64 (FIG. 3) moreover comprises a lower arm 158, 159 having at its end a lug 126, 127 which co-operates with the end 123, 124 of the rocking lever 117 and a second lug 161, 162 (FIG. 1) adapted to co-operate with a control element 163 of the two sensing elements 63 and 64.

A spring 166, 167 (FIG. 3) fitted between the bail 63, 64 and a positioning element 168, 169 urges the bail 63, 64 towards the respective spool 31, 32 (FIG. 1) and the positioning element 168, 169 (FIG. 3) towards the respective gear 146, 147.

The control element 63 (FIG. 1) comprises a substantially T-shaped lever having at one end a semi-circular portion 181 (FIG. 4) adapted to co-operate with an opposing element or part 182 of the cartridge 11, and at the other end two shoulders 183, 184 (FIG. 1) adapted to co-operate with the lugs 161 and 162 of the sensing elements 63 and 64. The lever 163 moreover has two lugs 186 by means of which it pivots on a spindle 187 fixed to two lugs 188 of the upper plate 78. A spring 180 tends to cause the lever 163 to turn clockwise in FIG. 4 so as to engage the lugs 161 and 162 with the shoulders 183 and 184, causing the sensing element 63 to turn anticlockwise and the sensing element 64 to turn clockwise in opposition to the action of the respective springs 166 and 167 (FIG. 3) to shift them from an operative position in which they sense the amount of ribbon 23 (FIG. 1) to an inoperative position close to the catch 81, in which they are arrested with the arms 150, 151 against the edges 189, 190 of the slots 164 and 165. This happens when the cartridge 11 is removed from the machine. The control elmment 163 (FIG. 4) and the hook element 154 are shown in chain-dotted lines in FIG. 4 in the position in which the cartridge 11 has been removed from the machine.

Figure 4:
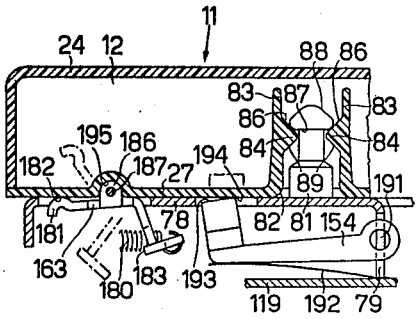
FIG. 4 is a partial longitudinal view of other details of FIG. 1.

The hook element 154 is pivoted on two lugs 191 of the support 79 and a leaf spring 192 urges it clockwise in FIG. 4 so that the two corresponding teeth 152 and 153 (FIG. 1) formed from the hook element 154 are located in the path of the arms 150, 151, very close to them when the cartridge 11 is removed from the machine. On the other hand, when the cartridge 11 is put on, the hook element 154 is arrested by a shoulder 193 projecting from an opening 205 in the plate 78 against another opposing element or part 194 (FIG. 4) of the cartridge 11.

The base 27 of the cartridge 11 includes both the first opposing part 182 and the second opposing part 194, which have a substantially plane form adapted to cooperate with the semi-circular portion 181 of the control element 163 and with the shoulder 193 of the hook element 154, respectively, when the cartridge 11 is mounted on the machine. The base 27 moreover comprises a semicircular seat 195 adapted to accommodate the lugs 186 of the control element 163 and the lugs 188 (FIG. 1) of the upper plate 78, and two holes 200 (only one is visible) adapted to accommodate the ends of the spindle 187 on which the control element 163 pivots. Finally, the base 27 comprises two slots 196, 197 substantially aligned with the slots 164 and 165 of the plate 78 and adapted to permit the passage of the lugs 61 and 62, with their caps 156 and 157, of the sensing elements 63 and 64 up to the spools 31 and 32.

The support 79 (FIG. 2) moreover comprises a lug 198 adapted to cooperate with a fixed stop 199 to limit the upward tilting of the support and the cartridge thereon, so as to dispose the portion of the ribbon 23 protruding from the openings 19 (FIG. 1) opposite a printing point on the platen 16 on the depression of each alphanumeric key as described hereinafter. The portion of the ribbon 23 (FIG. 2) and the lug 198 are shown in the working position by chain-dotted lines.

The teeth 51 and 52 (FIG. 1) of the transport elements 53 and 54 (FIG. 3) comprise two inclined surfaces 201 (FIG. 2) which terminate in an edge 202 adapted to bear against the bottom part of the flanges 48 and 49 (FIG. 1). Similarly, the teeth 46 and 47 comprise two inclined surfaces 203 which terminate in an edge 204.

Each positioning element 168, 169 (FIG. 3) can turn on a pin 211, 212 of the support 79 and comprises a lug 213, 214 adapted to co-operate with the lug 133, 134 of the ratchet device 131, and a shoulder 216, 217 adapted to co-operate with the respective gear wheel 146, 147 of the transport element 53, 54.

In order to replace an exhausted cartridge 11 on the machine by another, fresh cartridge, the action taken is as follows. The cartridge 11 is gripped with one hand at the side walls 26 and an upward pull is exerted to disengage the projections 84 (FIG. 4) from the stud 81. The opposing parts 182 and 194 of the base 27 release the control element 163 and the hook element 154, both of which turn clockwise owing to the action of the springs 180 and 192. The control element 163 engages by means of the shoulders 183 and 184 (FIG. 1) the corresponding lugs 161 and 162 of the sensing elements 63 and 64, causing the first to turn anti-clockwise and the second to turn clockwise in opposition to the action of the respective springs 166 and 167 (FIG. 3). At the same time, the hook element 154 (FIG. 1) disposes the inclined part of the teeth 152 and 153 in the paths of the arms 150 and 151, but does not prevent the movement thereof until their arrest against the edges 189 and 190 of the plate 78. The caps 156 and 157 of the sensing elements 63 and 64 are free in the slots 196 and 197 and distant from the spools 31 and 32, so that the cartridge 11 is completely free to be removed from the support 79 of the machine.

Figure 2:
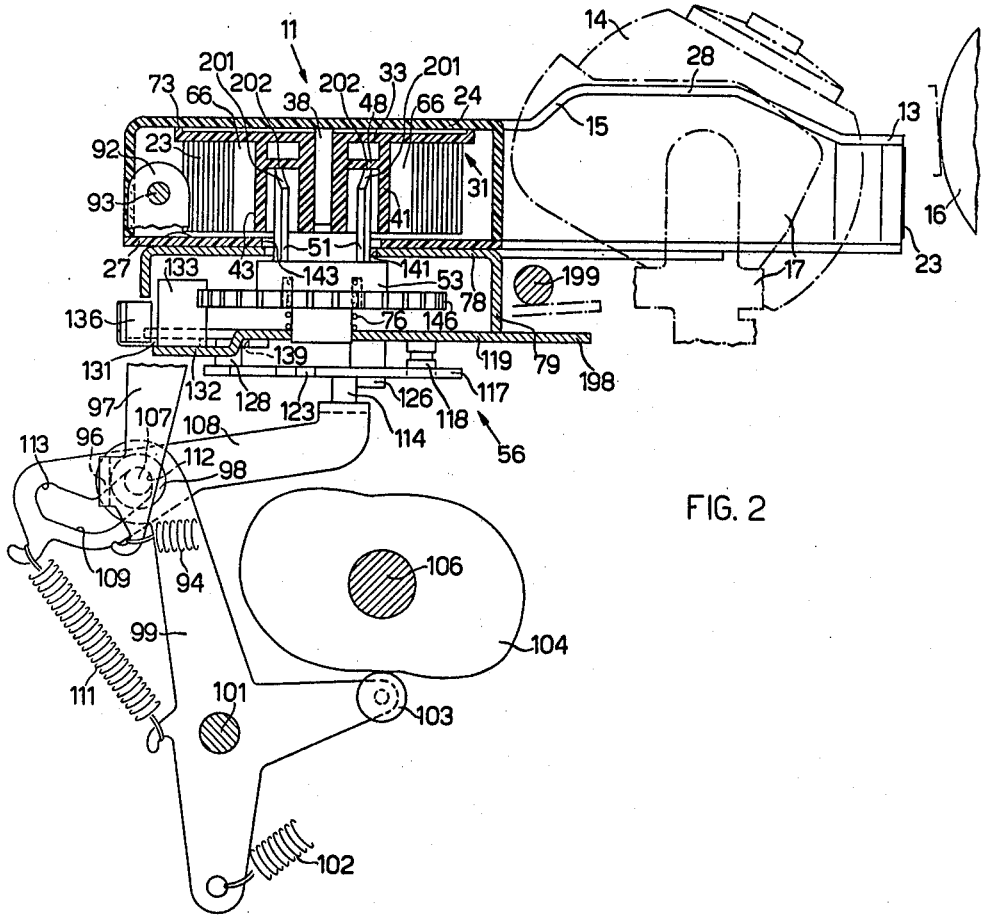
FIG. 2 is a longitudinal view, partly in section, of FIG. 1.

The springs 76 (FIG. 2) now raise the respective transport elements 53 and 54 (FIG. 3) until they are arrested against the bottom surface of the plate 78 (FIG. 2).

Taking now a fresh cartridge 11, it is positioned above the plate 78 (FIG. 4), correctly registered relative to the stud 81. On lowering the cartridge 11 towards the upper plate 78, the opposing element 182 engages the semi-circular portion 181 of the control element 163, causing it to swing anti-clockwise in opposition to the action of the spring 180 so as to release the lugs 161 and 162 (FIG. 1) of the sensing elements 63 and 64 from the shoulders 183 and 184. The sensing elements 63 and 64 therefore remain in a position close to the inoperative position, coupled to the teeth 152 and 153 of the element 154. The teeth 51 and 52 of the transport elements 53 and 54 engage the teeth 46 and 47 of the spools 31 and 32, rendering them fast with the transport elements 53 and 54. In the event of the teeth 46 and 47 of the spools 31 and 32 being in correspondence with the teeth 51 and 52 of the transport elements 53 and 54, there may be a momentary sticking or stoppage. Since, however, both the teeth 51 and 52 and the teeth 46 and 47 have the inclined surfaces 201 and 203 at their ends, the respective apices 202 and 204 slide on the said inclined surfaces, causing the spools 31 and 32 to rotate in one direction or the other and thus enabling the teeth 51 and 52 to engage the teeth 46 and 47, assisted therein by the springs 76 (one shown on FIG. 2).

The edges 89 (FIG. 4) of the projections 84 now engage the conical head 88 of the stud 81, causing the resilient tongues 83 to spread open. On further pushing the cartridge 11 towards the upper plate 78, the edges 89 cease their engagement with the conical head 88, as a result of which the edges 86 engage the shoulder 87 of the stud 81 with a snap action, thus locking the cartridge 11 on the plate 78. At the same time, the opposing element 194 engages the shoulder 193 of the hook element 154, causing this to swing anti-clockwise in opposition to the action of the spring 192. The teeth 152 and 153 (FIG. 1) thus release the arms 150 and 151, as a result of which the springs 166 and 167 (FIG. 3) cause the sensing elements 63 and 64 to rotate towards the respective spools 31 and 32 (FIG. 1). The fresh cartridge 11, therefore, now remains fixed removably to the plate 78 of the support 79 with the sensing elements 63 and 64 in contact with the outer turns of the inked ribbon 23 wound on the respective spools 31 and 32.

Even if during the mounting of the cartridge 11 on the machine the precaution is not taken of keeping the base 27 substantially parallel to the plate 78, the sensing elements 63 and 64 remain in the inoperative position, disengaged from the respective spools 31 and 32, through the agency of the hook element 154, as hereinbefore described, so that no interference can occur between the caps 156 and 157 and the spools 31 and 32. Only when the snap locking device has positioned the cartridge 11 correctly on the plate 78 does the opposing element 194 (FIG. 4) swing the hook element 154, releasing the sensing elements 63 and 64 (FIG. 1).

When the cartridge 11 is fixed removably on the plate 78 of the support 79, the spools 31 and 32 remain bearing by means of the flanges 48 and 49 against the apices 202 of the teeth 51 and 52 in opposition to the action of the springs 76 (FIG. 2), so that the transport elements 53 and 54 are disengaged from the bottom surface of the plate 78 and the spools 31 and 32 are held with the rims 73 and 74 against the bottom surface of the cover 24 of the cartridge 11. This causes the spools 31 and 32 not to oscillate vertically during the movement of raising of the cartridge 11 towards the printing point, as described hereinafter. Moreover, the possibility of vibration being able to unwind or loosen the ribbon 23 from the spools themselves during non-printing cycles of the machine is avoided.

During the changing of the cartridge 11, the length of ribbon 23 protruding from the arms 13 (FIG. 1) may not be under tension. However, as soon as the first printing cycles take place, the ribbon 23 is rapidly brought back under tension. Moreover, during operation, the sensing elements 63 and 64 exert a certain pressure on the turns of the ribbon 23 and, in turn, prevent both their unwinding and their slackening.

The raising of the cartridge 11 and the reversing mechanism 56 (FIG. 3) for the movement of advance of the inked ribbon 23 (FIG. 1) function in the following manner. Let it be assumed that the pin 107 (FIG. 2) is engaged with the end 112 of the slot 109. The rocking lever 117 (FIG. 3) and the ratchet device 131 are then in the position shown in FIG. 3, in which the ratchet device 131 is shifted to the left, as viewed from the front of the machine, so that the lug 133 meshes with the gear wheel 146. The inked ribbon 23 (FIG. 1) then unwinds from the spool 32 and is wound on the spool 31, moving from left to right in FIG. 1.

At rest or in the inoperative state, the length of ribbon 23 outside the cartridge 11 is disposed below the printing point and does not obstruct vision of the line being printed. On depressing an alphanumeric key (not shown in the drawings), the driving shaft 106 (FIG. 2) is rotated cyclically through 180° as described in our above-mentioned specification. The cam 104 causes the lever 99 to turn clockwise in opposition to the action of the spring 102, shifting the pins 98 and 107 towards the platen 16. The spring 94 then causes the support 79 to turn anti-clockwise on the pins 93 together with the cartridge 11 until the support 79 is arrested by the lug 198 against the fixed stop 199. The cartridge 11 thus positions the ribbon 23 in front of the printing point. As described in the above-mentioned specification, the head 14 positions the selected character and is then caused to strike against the platen 16, carrying with it that portion of the inked ribbon 23 which protrudes from the arms 13.

The pin 107 seated against the slot end 112 causes the rocking lever 117 to turn anti-clockwise through the medium of the connecting rod 108 and, by means of the pins 128 (FIG. 3), the rocking lever causes the ratchet device 131 to slide back (towards the bottom of FIG. 3).

The shifting of the ratchet device 131 corresponds to an angular step of the gear 146, the lug 133 jumps over a tooth of the gear 146 and engages the following space, keeping the gear 146 stationary. The ratchet device 131 co-operates by means of the projection 137 with the cam surface 139 through the action of the spring 140. The lug 134 remains disengaged from the gear 147 and, moreover, keeps the positioning element 169 also disengaged from the gear 147.

After the cam 104 (FIG. 2) has rotated through about 90°, the spring 102 causes the lever 99 with the pins 98 and 107 to turn anti-clockwise. Through the medium of the connecting rod 108, the pin 107 causes the rocking lever 117 (FIG. 3) to turn back clockwise, shifting the ratchet device 131 forward (towards the top of FIG. 3), the ratchet device causing by means of the lug 133 a clockwise rotation of the gear 146 and, therefore, of the corresponding spool 31 (FIG. 1). The ribbon 23 is, therefore, wound on the spool 31 and unwound from the spool 32. The pin 98 (FIG. 3) engages the lug 96 of the arm 97 (FIG. 2), causing the support 79 to turn clockwise in opposition to the action of the spring 94, bringing the support 79 and the cartridge 11 back to rest or the inoperative position.

After the cam 104 has rotated through 180°, the cycle is arrested, so that the entire reversing mechanism 56 returns to the position of FIG. 3.

The ribbon 23 (FIG. 1) continuing to unwind from the spool 32, gradually shifts the sensing element 64 towards the centre. When the spool 32 presents the first recess 58 free from the ribbon 23 in correspondence with the lug 62, while the rocking lever 117 (FIG. 3) is positioning the ratchet device 131 towards the gear 146, the spring 167 causes the sensing element 64 to turn rapidly anti-clockwise. The lug 127 is disposed in the path of the end 124 of the rocking lever 117 which, at the beginning of the return stroke, is arrested against the lug 127, while the lever 99 with the pin 107 continues to turn anti-clockwise owing to the action of the spring 102 (FIG. 2). Since the rocking lever 117 is arrested, a resisting force greater than the tension of the spring 111 is created, as a result of which the pin 107 slides in the slot 109 until it is arrested against the slot end 113. During this movement, the ribbon 23 (FIG. 1) does not advance and the rocking lever 117 (FIG. 3), with the ratchet device 131, is positioned in the position opposite to that shown in FIG. 3, in which the projection 136 co-operates with the cam 138. The lug 133 and the positioning element 168 are disengaged from the gear 146, while the lug 134 and the positioning element 169 come into engagement with the gear 147.

On each subsequent depression of the alphanumeric keys, the cam 104 (FIG. 2) commands the shifting of the lever 99 and of the connecting rod 108, as hereinbefore described. During the anti-clockwise rotation of the rocking lever 117 (FIG. 3), it now causes the gear 147 and the associated spool 32 (FIG. 1) to turn anti-clockwise by means of the lug 134 of the ratchet device 131, winding the ribbon 23 on the spool 32 and unwinding it from the spool 31.

During the return stroke, on the other hand, the rocking lever 117 (FIG. 3) causes the ratchet device 131 to slide back (towards the top of FIG. 3), so that the lug 134 slides on the tooth until it engages the adjacent space and keeps the gear 147 still. The lug 62 (FIG. 1), as a result of the action of the corresponding spring 167 (FIG. 3), remains resting in the recess 58 (FIG. 1) until, by rotating, the spool 32 moves it away, first with the inclined wall 67 and then with the ribbon 23, which is wound on the spool 32. The lug 61 in turn, on the other hand, shifts radially owing to the action of the spring 166 (FIG. 3) towards the centre of the spool 31 (FIG. 1) prearranging itself for a subsequent reversal, similarly to what has been described in the case of the lug 62, until the sliding of the pin 107 (FIG. 2) in the slot 109 is caused until it is arrested against the slot end 112, repositioning the ratchet device 131 in the position shown in FIG. 3.

What is claimed is:

1. An inked ribbon cartridge removably fittable on a printing machine, wherein the inked ribbon is wound on two spools rotatable in the cartridge and the printing machine is of the type including a ribbon reversal feed mechanism comprising a support on which the cartridge is fittable; two transport elements rotatably projecting from said support; two sensing elements movable between an operative position in contact with the spools and an inoperative position away from the spools, said sensing elements, in said operative position, sensing a predetermined minimum number of turns of ribbon thereon for rotating one or another of said two transport elements in one predetermined sense of rotation; and a control element projecting from said support and movable thereon between a first and a second position for shifting said sensing elements between said operative position and, respectively, said inoperative position and means for holding said control element in said second position when the cartridge is removed from said support; said cartridge comprising:

a container including a top wall and a bottom wall;

a side wall interconnecting said top wall with said bottom wall and defining a pair of slots for the passage of said inked ribbon from the one to the other of said spools outside said container;

means rotatably supporting said spools in said container about axes substantially perpendicular to said bottom wall;

means for accommodating said transport elements concentrically with said spools, said spools being provided with corresponding engaging means for engaging said transport elements in response to the fitting of the cartridge on the machine;

at least one aperture in said bottom wall for the access of said sensing elements to said two spools allowing said sensing elements to be freely shifted from said inoperative position to said operative position and viceversa; and an opposing element in said bottom wall for moving said control element from said second position to said first position in response of the fitting of the cartridge on said support, so that the movement of said sensing elements from said inoperative position to said operative position is obtained with the sole fitting movement of the cartridge.

2. A cartridge as in claim 1, wherein said support comprises a catch element for removably fixing the cartridge on the support and wherein said cartridge comprises a hole in said bottom wall adapted to accommodate said catch element and resilient tongues, disposed in said hole and cooperating with said catch element for keeping said bottom wall arrested against said support, and said control element arrested in said second position.

3. A removable cartridge as in claim 2 wherein said opposing element comprises a part of said bottom wall which cooperates with said control element when said container is rested on said support and wherein said hole is in a position equidistant from said transport elements.

4. A cartridge as in claim 3, wherein said at least one aperture comprises a pair of apertures each associated with one of said spools for access of said sensing elements, and wherein said two apertures are disposed on mutually opposite sides with respect to said hole and said opposing element.

5. An inked ribbon cartridge, wherein the ribbon is wound around two spools and which is removably mountable in printing machine of the type comprising a cartridge support; two transport elements rotatably projecting from said support and each associated with one spool of said spools; two sensing elements associated with said transport elements for sensing that a predetermined minimum quantity of wound ribbon is available for use and each having a lug for cooperating with the ribbon wound on the one associated spool; spring means urging said lugs of said sensing elements from an inoperative position away from said transport elements to an operative position near said spools which cooperate with said ribbon; motive means responsive to the position of each lug for rotating one or another of said two transport elements in one predetermined sense of rotation; a control element projecting from said support and normally maintaining each lug in the inoperative position in opposition to the action of said spring means when the cartridge is removed from said support; and hook means movable on said support between a first and a second position into the path of said sensing elements to arrest and release, respectively, the sensing elements in a position proximate to the inoperative position of said lugs in opposition to the action of the said spring means; said cartridge comprising:

a container having a top portion, a bottom portion, a side portion having a pair of openings for the passage of said inked ribbon from the one to the other of said spools outside said container and, means for rotatably supporting said spools inside said container;

means for accommodating said transport elements concentrically with said spools being provided with corresponding engaging means for being engaged by said transport elements;

at least one aperture in the bottom portion of said container for the access of the lugs of said sensing elements to said two spools;

means for removably fixing the container on the support including a snap locking device;

an opposing element on the bottom portion of said container cooperative with said control element in response of the fitting of the cartridge on said support for causing said sensing elements to be shifted from said inoperative position toward said operative position; and another opposing element on the bottom portion of said container, for moving said hook means to said second position for causing said spring means to move said sensing elements from the position proximate said inoperative position to said operative position only when the cartridge is correctly mounted on said support by said snap locking device.

6. A cartridge as in claim 5, wherein said hook means comprise two teeth adapted to arrest the sensing elements in said proximate position and a shoulder cooperating with said second opposing element when said cartridge is rested correctly on said support.

7. A cartridge as in claim 5, wherein said snap locking device comprises a catch element projecting from said support in a position equidistant from said transport elements, and the container of said cartridge comprises a hole adapted to accommodate said catch element and resilient coupling means, disposed in the said hole, for fixing through a snap action said catch element with said coupling means keeping the bottom portion of said container against said support.

8. A cartridge as in claim 7, wherein said hole is disposed in the bottom portion of said container and said other opposing element is substantially aligned with said one opposing element and with said hole.

9. A removable cartridge for an inked ribbon of a printing machine of the type including a ribbon reversal feed mechanism comprising a support, two transport elements rotatably projecting from said support, two sensing elements for rotating one or another of said two transport elements in one predetermined sense of rotation and a control element projecting from said support and movable thereon between a first and a second position for shifting said sensing elements from an operative position to an inoperative position; said cartridge comprising:

a container including a top wall and a bottom wall;

a side wall interconnecting said top wall with said botton wall;

two spools each one fixing an end of the inked ribbon and around which said ribbon is wound in coils, said side wall defining a pair of slots for the passage of said inked ribbon from the one to the other of said spools outside said container;

means rotatably supporting said spools in said container about axes substantially perpendicular to said bottom wall;

means for accommodating said transport elements concentrically with said spools, said spools being provided with corresponding engaging means for engaging said transport elements;

at least one aperture in said bottom wall for the access of said sensing elements to said two spools;

means for removably fixing the cartridge on the support; and an opposing element comprising a part of said bottom wall for cooperating and moving said control element from said second position to said first position in response to the fitting of the cartridge on said support for causing said sensing elements to be shifted from said inoperative position to said operative position; means being provided for returning said control element to said first position when the cartridge is removed from said support for causing said sensing elements to be returned from said operative position to said inoperative position, and wherein said support includes a spindle about which said control element is pivoted outside said support, and said bottom wall includes a semicylindrical seat for accommodating said spindle of said control element.

10. A removable cartridge for an inked ribbon of a printing machine of the type including a platen; a substantially spherical head carrying types distributed along columns and rows; a support member rotatably supporting said head around a substantially vertical axis for the selection of the columns of types externally to the head; a base pivoting member pivotally supporting said support member with respect to a horizontal axis for selecting the rows of types externally to said support member, said base member being movable with respect to said platen for the printing of the selected types during use of the machine; and a ribbon feed mechanism comprising a support means for lifting said support with respect to said platen, and means for feeding said ribbon in front of said type head; said cartridge comprising:

a substantially parallelepipedal container carrying therewithin said inked ribbon and including a top portion, a bottom portion and side portions interconnecting said top portion with said bottom portion; and a pair of arms, each protruding from a side portion of said container and having at an end thereof an opening for the passage of a section of said inked ribbon outside said container in front of said platen, said head being housed between said arms;

wherein the ends of said arms converge towards said head as to limit the unguided portion of ribbon outside said container substantially at the columns of types disposed in front of said platen upon lifting of said support; and wherein said top portion includes two shrouds which extend from said top portion inwardly of said arms and each of said shrouds having a first part stepped upwardly with respect to said arms over said pivoting member to protect the same from contact with small objects during use of the machine and a second part sloped down toward the platen to allow the printed characters to be seen.

11. In a ribbon feed mechanism for inked ribbon for a printing machine of the type comprising two spools carrying said ribbon; a pair of sensing elements for sensing a predetermined minimum number of turns of ribbon on said spools; a pair of transport elements each having a gear wheel rotatable for feeding said ribbon from one to the other of said spools; a ratchet device having a pair of feed elements associated with said gear wheels; means supporting said ratchet device for the movement thereof between a first and a second position causing one of said feed elements to cooperate with one of said gear wheels for the feeding of the ribbon in a first direction and between a third and a fourth position, causing the other of said feed elements to cooperate with the other of said gear wheels, for the feeding of the ribbon in a second direction opposite to said first direction, and a driving member having a cycle reciprocating movement; the combination comprising:

means for variably connecting said ratchet device with said driving member in a first and a second reciprocal position for causing said ratchet device to be moved between said first and said second positions and between said third and said fourth positions, respectively, in response to the reciprocating movement of said driving member;

spring means keeping said ratchet device in either of said first or second reciprocal positions for causing said driving member, to move said ratchet device through return strokes from said first position to said second position when the ratchet device is in said first reciprocal position and, respectively, from said third to said fourth position when the ratchet device is in said second reciprocal position;

means for causing said feed elements to rotate the associated gear wheel only during the return strokes of said ratchet device for the feeding of said ribbon; and stop means, controlled by said sensing elements, for arresting the ratchet device near the first position and, respectively, the third position thereof when the predetermined minimum number of turns wound on a spool is detected, for causing said driving member to be moved against the action of said spring means until the second and, respectively, the first of said two reciprocal positions has been reached, so that said feed elements are moved from cooperation with the one gear wheel to cooperation with the other and the feeding of the inked ribbon is reversed.

12. A feed mechanism according to claim 11 wherein the first reciprocal position of said ratchet device is constituted by said first position and said second reciprocal position is constituted by said third position.

13. A mechanism according to claim 11, wherein said connecting means comprise a rocking lever having two arms and, each of said sensing elements comprises a bail, each associated with one of said spools and one of said arms, each bail having an upper arm for sensing the turns of ribbon on one of said spools and a lower arm, said lower arm cooperating with one of said arms in the first and, respectively, second reciprocal positions of said ratchet device and, each bail on detection of the predetermined minimum number of turns of the wound ribbon, of the associated spool, arranging said lower arm in the path of the associated arm of said rocking lever for arresting the same during the return strokes of said ratchet device to move said ratchet device from one to the other of said first or second reciprocal positions.

14. A feed mechanism according to claim 11, wherein said connecting means comprises a pin and slot connection between the driving member and the ratchet device, said two reciprocal positions being defined by the stable contact of said pin with one or another end of said slot effected by said spring means.

15. A feed mechanism according to claim 14, wherein said driving member comprises an oscillating lever fixing said pin and said connecting means comprise a connecting rod in which is formed said slot, which substantially V-shaped and houses said pin and wherein said spring means connect said oscillating lever with said connecting rod.

16. A feed mechanism according to claim 11, wherein said transport elements are rotatably mounted on a support pivotally mounted in front of a printing point of the machine, wherein said spools are rotatable in a container of an inked ribbon cartridge removably mountable on said support and carrying the ribbon near said printing point, wherein said support is provided with an arm pivotally connected with said driving member and wherein said connecting means comprise a rocking lever pivotally mounted on said pivotable support.

17. A mechanism according to claim 11, wherein said feed elements comprise two lugs of the ratchet device and said ratchet device comprises a slider moved by said driving member parallel to said gear wheels for engaging the teeth of said wheels selectively, and wherein said means for rotating the gear wheels only during the return stroke comprise two projections of said ratchet device associated with said lugs, and two cam surfaces of said support means cooperating selectively with said two projections so that when said ratchet device is in one of said two positions, only one of said lugs cooperates with one respective gear wheel and the projection associated with the other lug cooperates with the corresponding cam surface to keep said other lug disengaged from the other respective gear wheel and vice-versa.

18. A feed mechanism for an inked ribbon of a printing machine of the type comprising a support, and two transport elements rotatably projecting from said support; wherein the ribbon is enclosed in a cartridge comprising a container including a top portion and a bottom portion; two spools rotatable in said container and each one fixing an end of the inked ribbon and around which said ribbon is wound in coils, said container having a pair of slots for the passage of said inked ribbon from the one to the other of said spools outside said container; holes in the bottom portion of said container for accommodating said transport elements concentrically with said spools, and said spools being provided with corresponding engaging means for engaging said transport elements; and at least one aperture in said bottom portion for the access to the ribbon coils of said two spools; said feed mechanism comprising two sensing elements each movable between an operative position in contact with the spools and an inoperative position arrested by said support away from said spools, said sensing element in said inoperative position allowing a free fitting of the cartridge on the support and in said operative position sensing a predetermined minimum number of turns of ribbon on said spools for rotating one or another of said two transport elements in one predetermined sense of rotation; spring means biasing the sensing elements towards said operative position; snap action fixing means for removably fixing the cartridge on the support in response to a fitting vertical movement of the cartridge; and a control element movable on said support for shifting said sensing elements from said operative position to said inoperative position against the action of said spring means; said control element comprising a lever cooperative with said sensing elements and pivoted on said support between a raised position and a lowered position; and a spring for normally keeping said lever in said raised position, the action of the spring of said lever prevailing over the action of said spring means acting on the said sensing elements so as to keep said sensing elements in said inoperative position, said lever in said lowered position releasing said sensing elements for the shifting thereof towards said spools under the action of said spring means; and said cartridge comprising an opposing element in the bottom portion of said container for moving said lever from the raised position to the lowered position in response to the fitting of the cartridge on said support against the action of the corresponding spring, so that the movement of said sensing elements from said inoperative position to said operative position is obtained with the sole fitting movement of the cartridge onto said support against the action of the spring of said lever, and the action of said snap action fixing means on said cartridge prevailing over the action of said lever on said cartridge by the spring of said lever.

* * * * *